United States Patent [19]

Hayden

[11] 3,964,007

[45] June 15, 1976

[54] NOISELESS AUTOMOTIVE RELAY

[75] Inventor: Rodney Hayden, Stoney Creek, Canada

[73] Assignee: TRW Inc., Cleveland, Ohio

[22] Filed: Apr. 3, 1975

[21] Appl. No.: 564,588

[52] U.S. Cl. ..... 335/187; 335/203

[51] Int. Cl.[2] ..... H01H 3/00

[58] Field of Search ..... 335/131, 187, 203, 261, 335/279

[56] References Cited

UNITED STATES PATENTS

| | | | |
|---|---|---|---|
| 3,168,627 | 2/1965 | Gilley | 335/187 |
| 3,175,066 | 3/1965 | Fiddler | 335/187 X |
| 3,593,240 | 7/1971 | Garczynski | 335/261 X |

*Primary Examiner*—George Harris
*Attorney, Agent, or Firm*—James R. O'Connor

[57] ABSTRACT

A relay structure for direct current automotive use in which the armature member moves slidably and noiselessly to place a movable contact in engagement with a pair of spaced, fixed electrical contacts. The armature includes a movable core, a contact and an insulate bar. The fixed contact engaging surfaces of the insulate bar and the contact are located in a common plane. The stationary core of the relay surrounds the movable core and the relay winding, the latter being located between the movable core and the stationary core.

6 Claims, 5 Drawing Figures

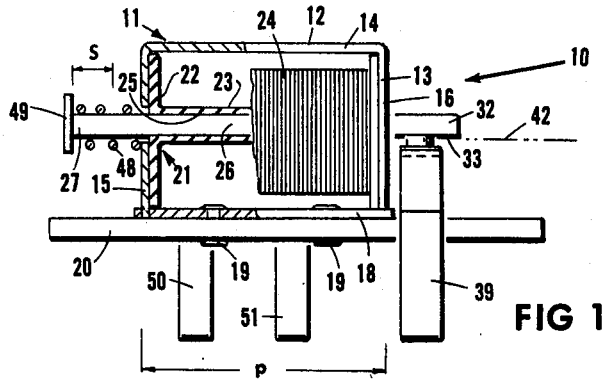
FIG 1
FIG 5
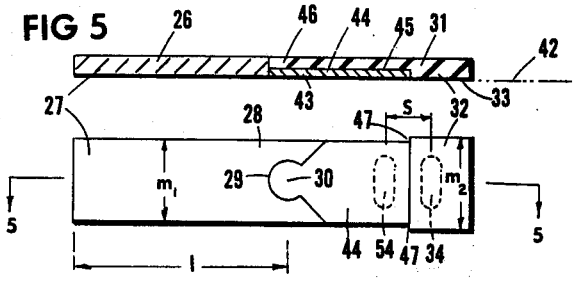
FIG 4
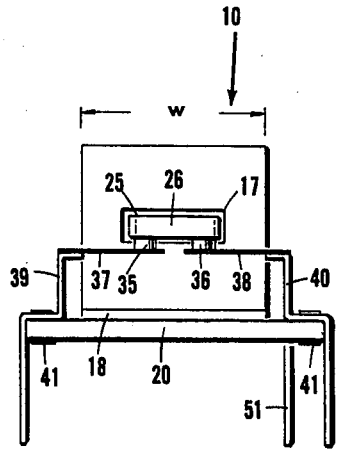
FIG 2
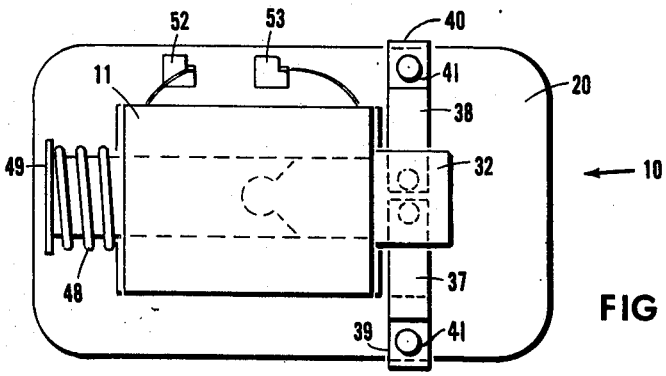
FIG 3

NOISELESS AUTOMOTIVE RELAY

BACKGROUND OF THE INVENTION

There is a need in automotive relay structures for a powerful, efficient relay adapted to be actuated without the clicking noise which usually accompanies the actuation of conventional relays having separated contacts adapted to be brought together when the relay winding is energized. The large number of relays used in control circuitry in automobiles of the present day results in contact clicking noises from numerous areas of the automobile. Accordingly, conventional relays in expensive automobiles are surrounded by sound dampening mediums such as foam rubber to reduce the emanation of sound generated by the closing of the relay contacts. In inexpensive automobiles the cost of the relay assemblies must be held to a minimum and sound dampening of clicking noises is practiced to a minimum. Accordingly, the increasing number of relays utilized in each new model series of automobiles increases the noise level thus creating the need for a quiet or substantially noiseless operating relay.

SUMMARY OF THE INVENTION

The main object of the present invention is to provide a relay having an armature structure which includes a movable core part carrying a contact for engaging the fixed relay contacts when the relay is energized and a movable insulate bar portion having a surface which is continuously in contact with the fixed contacts when the relay is not energized and wherein the movable core part of the armature is slidably disposed within the stationary core and the relay coil and is adapted to move slidably and noiselessly within a bore in a coil form part located within the stationary core to bring the contact on the movable core part into engagement with the fixed contacts.

Other objects of the invention will be appreciated by a study of the following description read in conjunction with the accompanying drawing.

BRIEF DESCRIPTION OF THE DRAWING

FIG. 1 is a side elevation partially cut away of the relay structure of the invention;

FIG. 2 is an end view of the relay as viewed from the right end of FIG. 1;

FIG. 3 is a top plan view of the relay of FIG. 1;

FIG. 4 is a bottom plan view of the movable armature assembly of the invention; and FIG. 5 is a section taken on the line 5—5 of FIG. 4.

DESCRIPTION OF A PREFERRED EMBODIMENT

The relay 10 of the invention includes a stationary core part 11 formed from a bar 12 of ferrous material of a width *w* which is bent to form an inverted U-shaped part 13 having a top wall 14 and end walls 15, 16, the latter having rectangular openings 17 formed therethrough. Said stationary core part is fixed to a base 18 of the same material and the base 18 is fastened by rivets 19 to an insulate base 20.

An insulate coil form part 21 is located within stationary core part 11 and includes end flanges 22 joined by a hollow tubular portion 23 which supports a relay winding 24 and has a rectangular bore 25 extending therethrough which slidably houses an armature member 26, which is shown in greater detail in FIGS. 4 and 5.

Armature member 26 has a movable core part formed of a magnetizable material and includes a first end portion 27 which normally extends out of one of the openings 17 in the stationary core part as shown in FIG. 1. The other end 28 of the armature has a keyhole-shaped recess 29 in which a segmental tongue part 30 of an insulate member 31 is permanently seated. The insulate member 31 has a portion of width $m_1$, but increases to a greater width $m_2$ in a head portion 32 having a contact engaging face 33. The contact engaging face 33 has a contacting zone 34 which normally engages contact buttons 35 and 36 which are mounted on spaced spring arms 37 and 38, respectively, which are in turn mounted on rigid terminal members 39, 40 fastened by rivets 41 to insulate base 20.

The contact engaging face 33 of insulate member 31 lies in a common plane 42 with fixed contacts 35, 36 and has contact engaging zone 34. Spaced rearwardly from the zone 34 and also lying in the common plane 42 is an electrically conducting surface 43 which is the undersurface of a part of copper plating or a copper plate 44 cemented into or plated into a recess 45 in a portion 46 of the insulate member 31.

In assembly, the relay winding 24 on coil form 21 is inserted into the stationary core part 11 to align the bore 25 with the core openings 17. The armature 26 is assembled by inserting its end 27 into the bore 25 in the coil support 23 from the right end of FIG. 1 until the head end 32 engages the coil form part flange 22 with its stepped edges 47. Rectangular spring 48 is then placed over the outwardly protruding end 27 of the armature 26 and held thereon by end cap 49 spot welded or otherwise fastened thereto.

When relay winding 24 is energized by direct current applied to winding terminal legs 50, 51 connecting to winding leads 52, 53, the normally projecting end 27 of the armature is drawn into bore 25 because the magnetizable portion 28 thereof is of a length *l* which is less than the length *p* of stationary core part 11. The projecting portion of end 27 will be drawn slidably in through a distance *s* at which point spring 48 is fully compressed and the movable contact 54 on surface 44 engages the fixed contacts 35 and 36. When relay coil 24 is deenergized, spring 48 returns armature 26 to the position shown in FIGS. 1 and 3 whereby insulate surface 33 is again in engagement with the fixed contacts 35, 36. It should be noted that the contacts 35, 36 never move during operation of the relay and, since they are at all times tensioned by their arms 37, 38 into continuous engagement with surfaces located in the common plane 42, the only noise generated is that generated by the sliding action of the surfaces 33 and 44 over the contacts 35, 36 which is practically inaudible. The edges 47 when engaging the winding form flange 22 on the return stroke are characterized by the engagement of nonmetallic material with nonmetallic material. It is accordingly preferred that the material of the insulate part 31 and of the coil form part 21 be of a medium hardness material such as nylon.

It will be observed that the assembly of the magnetizable and insulate portions of the armature is located essentially midway through the length of the coil 24 and coil support 23 when the armature is in the normal inactive position as shown in FIG. 1 and that the distance of movement of armature *s* when the relay is energized is necessarily less than one-half the length of the coil so that the coupling at 29, 30 is at all times located within the bore 25 of the coil support 23.

I claim:

1. A sliding contact relay comprising: an insulate coil form part having an axial bore of rectangular section extending therethrough; a coil mounted on said coil form part; a stationary core formed of magnetizable material substantially enclosing said coil and said coil form part; a rigid insulate base; means fastening said stationary core part to said base; openings in said stationary core in registry with the bore in said coil form part; an armature member having a cross section corresponding to the cross section of said bore and slidably seated therein; said armature including a magnetizable movable core part defining a portion of said armature and having a length not greater than the length of said bore and an insulate bar portion defining the remainder of said armature member and having a head portion of a larger corss sectional area than the cross section of said bore, said head portion having an insulate fixed contact engaging surface and said bar having secured thereto an electrically conductive metal contact bar having a contacting surface which lies coplanar with the undersurface of said head portion and is located on said insulate bar portion between said head portion and said movable core part of said armature; two spaced apart fixed electrical contacts including means for supporting same for engagement with said contact engaging surfaces responsive to energization or deenergization of said coil; and spring means normally biasing said armature to a position wherein the contacting surface of said head portion of said insulate bar portion contacts said fixed contacts and a portion of the movable core part of said armature projects out of one end of said bore.

2. A relay according to claim 1 wherein the insulate bar portion of said armature is connected to the movable core part thereof by interlocking elements of said portion and part.

3. A relay according to claim 1 wherein the insulate bar portion of said armature is connected to the movable core part thereof by interlocking elements of said portion and part, said interlocking elements being located substantially midway of the axial length of said bore when said armature is in the normally biased position.

4. A relay according to claim 1 wherein said spring means is disposed about the outwardly projecting portion of said movable core part and said core part carries spring retaining means fastened to the outward end thereof, said spring means normally biasing said armature to a position relative to said bore such that the head portion of said insulate bar is biased against one end of said coil form part.

5. A relay according to claim 1 wherein said contact bar is formed of electrically conductive metal plated onto said insulate bar portion.

6. The relay of claim 1 wherein said contact bar is in the form of electrically conductive metal plated onto said insulate bar portion and said insulate bar portion is connected to said movable core part by interlocking elements of said portion and part.

* * * * *